US007165987B2

(12) United States Patent
Kim et al.

(10) Patent No.: US 7,165,987 B2
(45) Date of Patent: Jan. 23, 2007

(54) INDUSTRIAL CONNECTOR ASSEMBLY

(76) Inventors: Frank Chin-Hwan Kim, 19224 181st. Ave. NE., Woodinville, WA (US) 98077; Phillip Phung, 9310 Northeast 125th St., Kirkland, WA (US) 98034

( * ) Notice: Subject to any disclaimer, the term of this patent is extended or adjusted under 35 U.S.C. 154(b) by 0 days.

(21) Appl. No.: 10/951,544

(22) Filed: Sep. 28, 2004

(65) Prior Publication Data

US 2006/0068625 A1 Mar. 30, 2006

(51) Int. Cl.
*H01R 13/52* (2006.01)

(52) U.S. Cl. ..... 439/271; 439/321

(58) Field of Classification Search ..... 439/271, 439/321, 277, 296, 312, 320
See application file for complete search history.

(56) References Cited

U.S. PATENT DOCUMENTS 3,517,371 A * 6/1970 Buckley ..... 439/321
3,601,761 A * 8/1971 Harris ..... 439/275
3,980,373 A * 9/1976 McCormick et al. ..... 439/155
5,222,909 A * 6/1993 Nomura et al. ..... 439/607
5,496,189 A * 3/1996 Over et al. ..... 439/321
6,234,819 B1 * 5/2001 Oka ..... 439/321
2005/0153591 A1 * 7/2005 Milner et al. ..... 439/321

OTHER PUBLICATIONS

Hubbell Incorporated, Hubell-Premise.com, The Hubbell Advantage, Hi-Impact For Harsh Environments, http://www.hubbell-premise.com/HarshEnv.com.asp, Dec. 22, 2004, 2 pages.
Hubbell Incoporated, Hubbell Premise Wiring, Connecting Hardware for Harsh Environments, Hi-Impact Category 5e Shielded Connector, DS-E14, Sep. 2004, 2 pages, Stonington, CT.
Hubbell Incorporated, Hubbell Premise Wiring, Connecting Hardware for Harsh Environments, Hi-Impact Category 5e Patch Cords, DS-E4, Jul. 2004, 2 pages, Stonington, CT.

* cited by examiner

*Primary Examiner*—Michael C. Zarroli
(74) *Attorney, Agent, or Firm*—George C. Rondeau, Jr.; Davis Wright Tremaine LLP

(57) ABSTRACT

A robust sealable electrical connector has a plug assembly to electrically couple wires of a cable typically within a room or other area that may have an adverse environment to wires behind a wall through a jack assembly typically mounted on the wall. When the plug assembly and jack assembly are engaged they provide a doubly sealed condition such that associated electrically conductive elements within the connector are protected from hostile environmental. The connector provides a sealed condition even when the plug assembly is partially disengaged from the connector housing or when an outward force is imparted to the plug assembly such as from vibrations or when a passerby becomes entangled with a cable extending from the plug assembly.

20 Claims, 14 Drawing Sheets

INDUSTRIAL CONNECTOR ASSEMBLY

BACKGROUND OF THE INVENTION

1. Field of the Invention

The present invention relates generally to connectors, and more particularly to sealed electrical and fiber optic connector assemblies.

2. Description of the Related Art

Sealable electrical connectors typically have a plug assembly that removably couples with a connector housing to provide a sealed engagement between the plug assembly and the connector housing. Engagement of the plug assembly and the connector housing provides an electrical connection between a cord, cable, or other such electrical conductor located typically within a room or other area and one or more wires of a cord or cable or other electrical conductor located typically behind a wall. A sealable electrical connector can be used in a room or area having an adverse environment such that when the plug assembly and connector housing of the sealable electrical connector are fully engaged in a sealed condition, associated electrically conductive elements such as tines or other type of electrical conductors being located either within the electrical connector or on the other side of a wall of the room are protected from hostile environmental elements. If nonsealable electrical connectors were used in these adverse environments, a potential exists that the nonsealable electrical connectors may expose associated electrically conductive elements to one or more harmful materials such as fluids, particulates, or other materials. These harmful materials could include gas vapors, particulates or liquids, which may produce explosions, short electrical circuits, or cause other detrimental effects.

Conventional approaches to implementing sealable electrical connectors can still require a level of care and a certain level of accommodation that may not be available under certain circumstances. As such, the conventional sealable electrical connectors may not be in a sealed condition unbeknownst and despite the best intentions of those associated with their use. For instance, users may not realize that certain caps, housings, or other sorts of enclosures of conventional sealable connectors need to be twisted, pushed, screwed or otherwise secured to a degree beyond what may appear to a particular uninformed user as being fully engaged to provide the sealed condition. In particular, a plug assembly may be partially unscrewed from a connector housing due to poor installation practice or may become partially disengaged during operation to cause an unsealed condition that most likely would be difficult to detect until a failure results. Discovery of this unsealed condition may be difficult since the partially disengaged condition may upon casual inspection falsely appear to be the fully engaged, sealed condition.

In other instances, external electrical cords or cables coupled to a sealed conventional sealable electrical connector may become entangled with a passerby causing a pulling force to be temporarily imparted on to the conventional sealable electrical connector thereby producing a temporary unsealed condition that may not ever be noticed or may be noticed through the resultant serious harm caused. Vibrations found in some environments, such as from nearby machinery, may also cause a force on the conventional sealable electrical connector that produces an unsealed condition. This may cause the conventional sealable electrical connector to repeatedly cycle from being unsealed to being sealed back to being unsealed based upon the frequency and amplitude of the vibrations found in the vicinity of the connector. This cycling unsealed condition may never be discovered until it is too late and the harm has been caused.

Conventional approaches have not sufficiently anticipated these or other events that can cause long term, temporary, and cycling unsealed conditions in conventional sealable electrical connectors. Consequently, although the conventional sealable connectors may appear to provide a seal, in realty they may not always be sealed. Conventional sealable electrical connectors may not provide a sufficient barrier between electrically conductive elements and hostile environmental elements when used within adverse environments. Similar problems exist for conventional fiber optic connectors used in adverse environments.

BRIEF SUMMARY OF THE INVENTION

The present invention resides in a connector assembly for use with a first connector configured to be operably coupled to a second connector and a housing with an inner surface extending along a first dimension to at least partially define an inner space and an open end to provide access to the inner space, the second connector being at least partially located within the inner space of the housing for access therewith through the open end of the housing. The connector assembly includes a body configured to receive the first connector, with the body being sized to be inserted at least partially into the inner space of the housing through the open end of the housing. The body has an outer surface. The connector assembly further includes a sealing member sealingly contacting both the outer surface of the body and the inner surface of the housing as the body is moved from a first position to a second position along the first dimension of the housing to provide a seal between the inner surface of the housing and the outer surface of the body.

In one illustrated embodiment of the invention, the connector assembly is configured for use with a housing with an end surface extending about the inner space toward the open end. In this embodiment, the body is sized to be inserted into the inner space of the housing through the open end of the housing to a fully inserted position whereat the first connector is operably coupled to the second connector of the housing. The body has first and second outer surfaces, with the first outer surface extending about and positioned outward of the second outer surface. The connector assembly further includes first and second sealing members.

The first sealing member is positioned at the first outer surface of the body and positioned for sealing contact with the end surface of the housing and the first outer surface of the body to provide a first seal between the housing and the body when the body is inserted into the housing and in the fully inserted position. The second sealing member sealingly contacts both the second outer surface of the body and the inner surface of the housing as the body is moved from the fully inserted position to a less than fully inserted position along the first dimension of the housing to provide a second seal between the housing and the body at all positions between the fully inserted position and the less than fully inserted position. The less than fully inserted position is defined as being spaced apart from the fully inserted position sufficient that the first outer surface of the body and the end surface of the housing are sufficiently distance that the first sealing member does not provide the first seal between the housing and the body. The second sealing member may be an O-ring, and the second outer surface may have a groove extending thereabout with the O-ring positioned therein.

Other features and advantages of the invention will become apparent from the following detailed description, taken in conjunction with the accompanying drawings.

BRIEF DESCRIPTION OF THE SEVERAL VIEWS OF THE DRAWING(S)

DETAILED DESCRIPTION OF THE INVENTION

A robust sealable electrical or fiber optic connector usable in industrial and other settings has a first connector assembly to couple wire or fiber conductors of a cable typically within a room or other area to wire or fiber conductors behind or in a wall through a second connector assembly typically mounted on the wall. When the first and second connector assemblies of the robust sealable connector are engaged they provide a sealed condition such that associated electrically or light conductive elements such as tines or other type of conductors found either within the robust sealable connector or behind a wall of the room are protected from potentially hazardous elements existing within the room or other area external to the sealable connector. In addition, the robust sealable connector can provide a fully sealed condition even when the first connector assembly is partially disengaged from the housing for the second connector assembly or when a pulling force is imparted such as when a passerby becomes entangled with an associated cord or cable or as a result of vibration. By way of background, a convention sealable electrical connector is first described.

Figure 1:
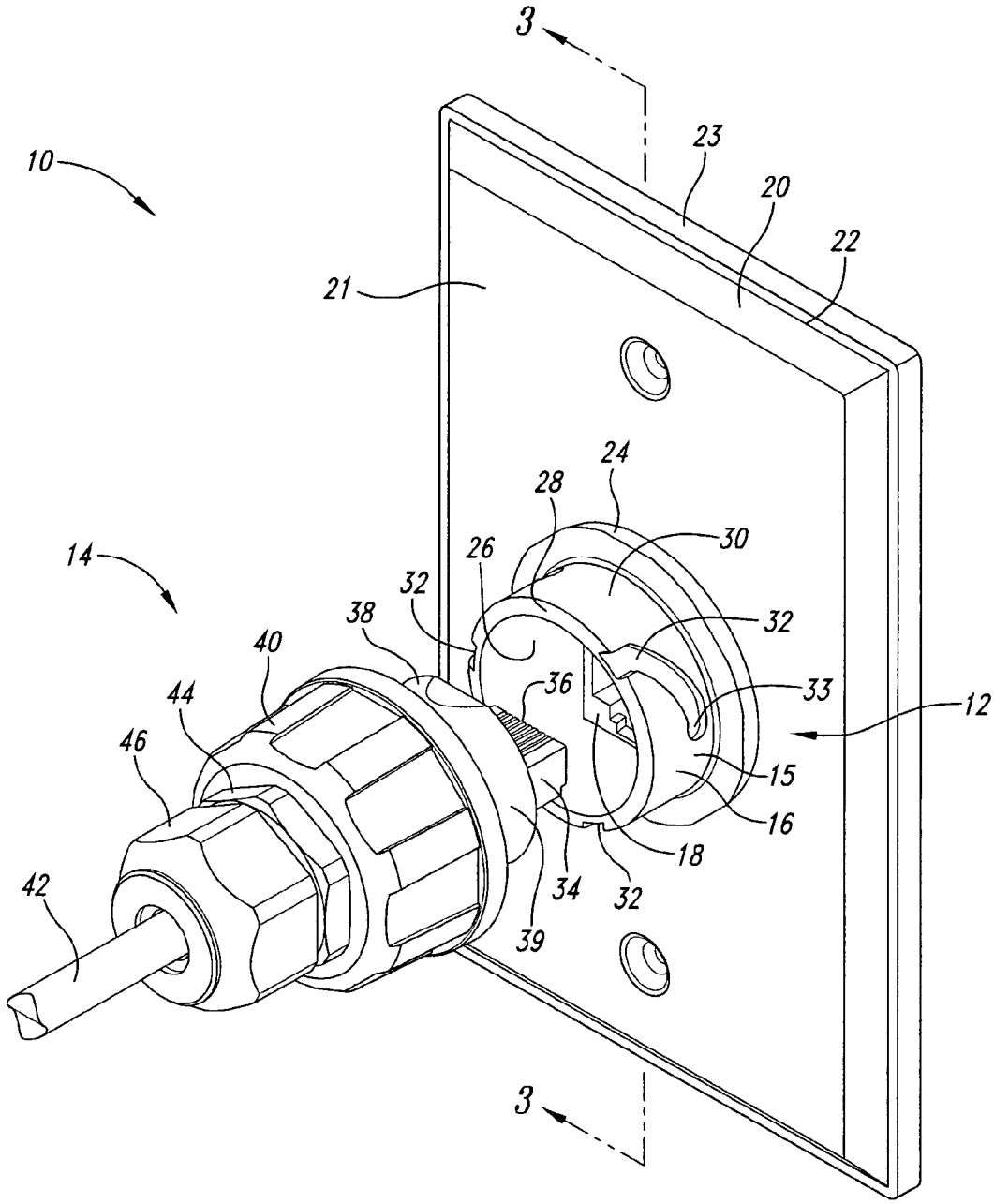
Fig. 1 (Prior Art)
FIG. 1 is an isometric view of a conventional sealable electrical connector shown in a unsealed condition with its plug assembly disengaged from its connector housing.
Figure 2:
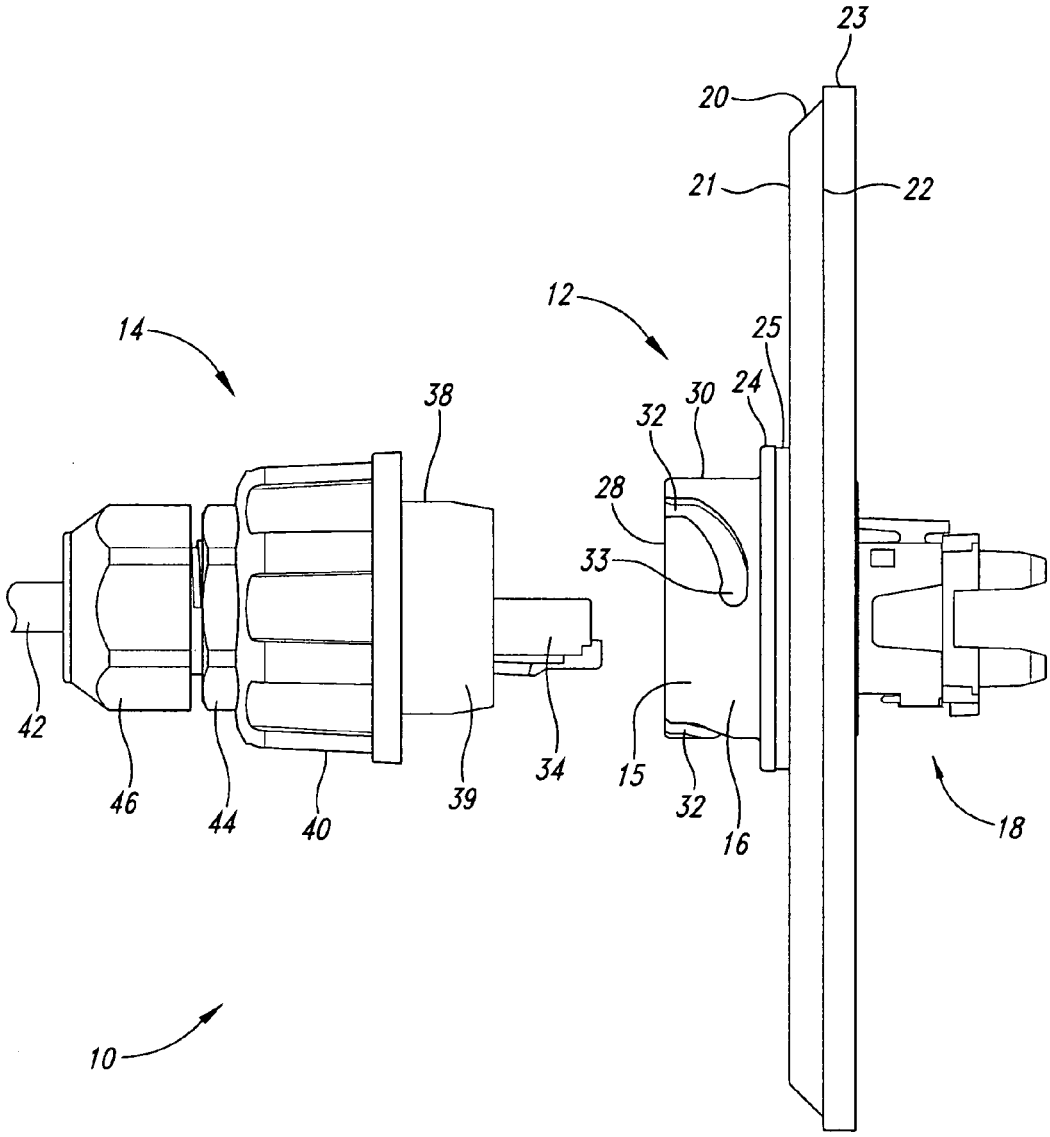
Fig. 2 (Prior Art)
FIG. 2 is a side elevational view of the conventional sealable electrical connector of FIG. 1.

A conventional sealable electrical connector 10 designed for industrial uses is shown in FIGS. 1 and 2 as having a jack assembly 12 and a plug assembly 14 which are configured to be releasably engaged together. The jack assembly 12 has a connector housing 16 with a forwardly extending forward portion 15 that is cylindrically shaped with a forward open end to receive portions of the plug assembly 14. A keystone contact jack 18 resides inside the connector housing 16 and has electrical tines (not shown) to electrically couple to the plug assembly 14. The connector housing 16 has a rearwardly extending threaded rearward portion 17 by which the connector housing is securely coupled to a wall plate 20 having a room side 21 and a wall side 22 to be positioned adjacent to a wall (not shown). A wall plate gasket 23 is located between the wall side 22 of the wall plate 20 and the wall to provide a seal therebetween, and a housing nut 19 located on the wall side of the wall plate is threadably received on the threaded portion 17 of the connector housing 16. The connector housing 16 has a flange 24 located along its midportion with a gasket 25 positioned between the flange and the room side 21 of the wall plate 20 to provide a seal between the connector housing and the wall plate.

The forward portion 15 of the connector housing 16 has an inner surface 26, a front end wall surface 28, and an exterior surface 30. The exterior surface 30 has engagement slots 32 formed therein and all shaped to promote tight coupling of the plug assembly 14 with the connector housing 16.

The plug assembly 14 has a contact plug 34, shown as an RJ45 plug, with contacts 36 configured to engage with the tines (not shown) of the contact jack 18 of the connector housing 16. The contact plug 34 is positioned within an aperture in a cover or cap body 38 of the plug assembly 14 having a front portion 39 shaped and sized to be inserted into the connector housing 16 as the contact plug 34 engages with the contact jack 18 and makes electrically contact therewith. Typically, the front portion 39 is partially cylindrically shaped to match the cylindrical shape of the inner surface 26 of the connector housing so as to be snugly inserted with a small clearance between the front portion 39 and the inner surface 26. Of course, the inner surface 26 of the connector housing 16 extends along the longitudinal dimension of the connector housing a sufficient distance to define an inner space sized to receive at least a portion of the cap body 38 therein and the front end wall surface 28 defines an opening through which the cap body is inserted.

Figure 3:
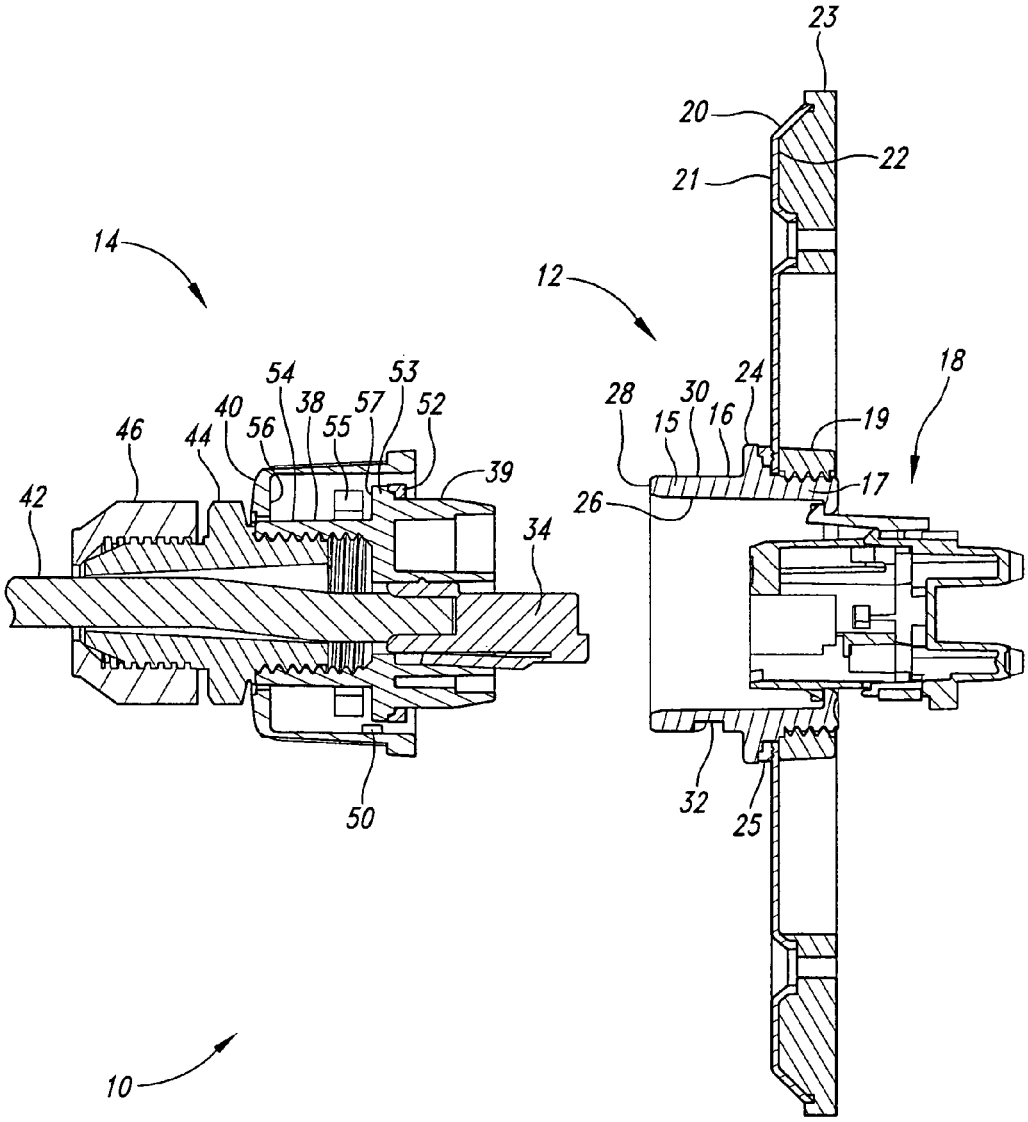
Fig. 3 (Prior Art)
FIG. 3 is a cross-sectional side elevational view of the conventional sealable electrical connector of FIG. 1.

The plug assembly 14 further includes a cover or cap 40 that is shaped to slip over the connector housing 16 and has interiorly projecting engagement lugs or members 50 (one shown in FIG. 3) to be received in the engagement slots 32 and engaged with the connector housing through rotation (clockwise rotation for the case depicted in FIG. 1) of the cover as the cover is being moved onto the connector housing and toward the wall plate 20. The cap 40 is secured to the connector housing 16 when each of the engagement members 50 reaches an end portion 33 (one shown in FIGS. 1 and 2) of the engagement slot 32 within which received. The plug assembly 14 is used to electrically couple a first set of wires inside an electrical cord or cable 42 (or other such electrical conductor) found typically within a room or other area on a side of the wall to which the wall plate 20 is attached through the jack assembly 12 to a second set of wires (not shown) that are located within the wall or on an opposite side of the wall. A cable retainer 44 and a retainer cap 46 physically. secure the cable 42 to a rear portion of the plug assembly 14 in a liquid tight fashion and provide strain relief. The first set of wires of the cable 42 are electrically coupled to the contacts 36 of the contact plug 34, and the second set of wires are electrically coupled to the tines of the contact jack 18. The plug assembly 14, cable 42, cable retainer 44 and retainer cap 46 may be part of an industrial patch cord with a plug positioned at the opposite end of the cable.

The contact jack 18 is mounted to the jack assembly 12 and projects interior of the inner surface 26 of the connector housing 16 from the wall side 22 of the wall plate 20. The contact jack 18 is electrically coupled to the contact plug 34 when the plug assembly 14 is fully coupled to the jack assembly 12, thus electrically coupling the first set of wires in the cable 42 to the second set of wires. The front portion 39 of the cap body 38 is shown in a fully inserted position in the inner space defined by the inner surface 27 of the connector housing 16 in FIG. 5 whereat the contact plug 34 in electrical contact with the contact jack 18.

Figure 4:
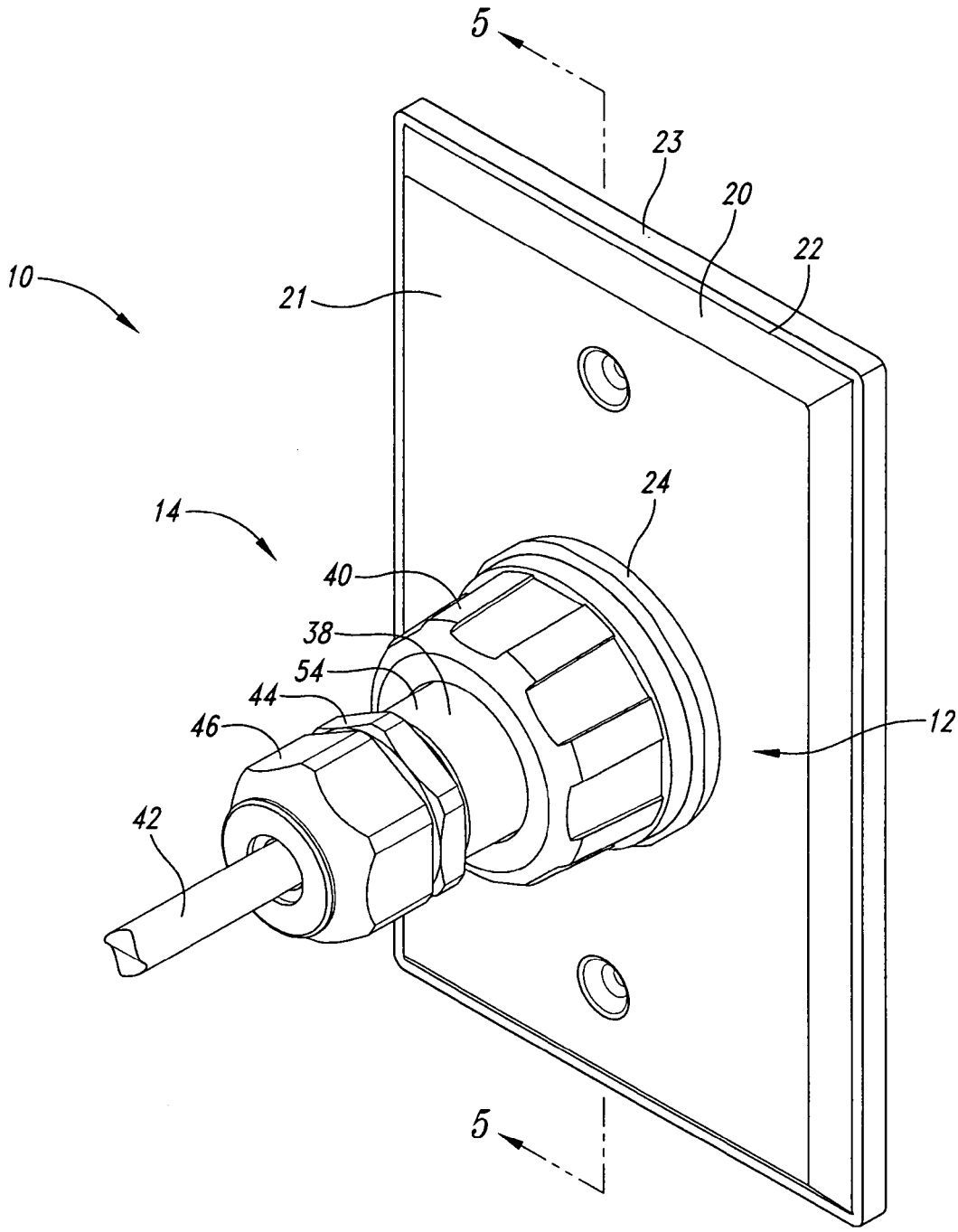
Fig. 4 (Prior Art)
FIG. 4 is an isometric view of the conventional sealable electrical connector of FIG. 1 shown in a sealed condition with the plug assembly engaged with the connector housing.
Figure 5:
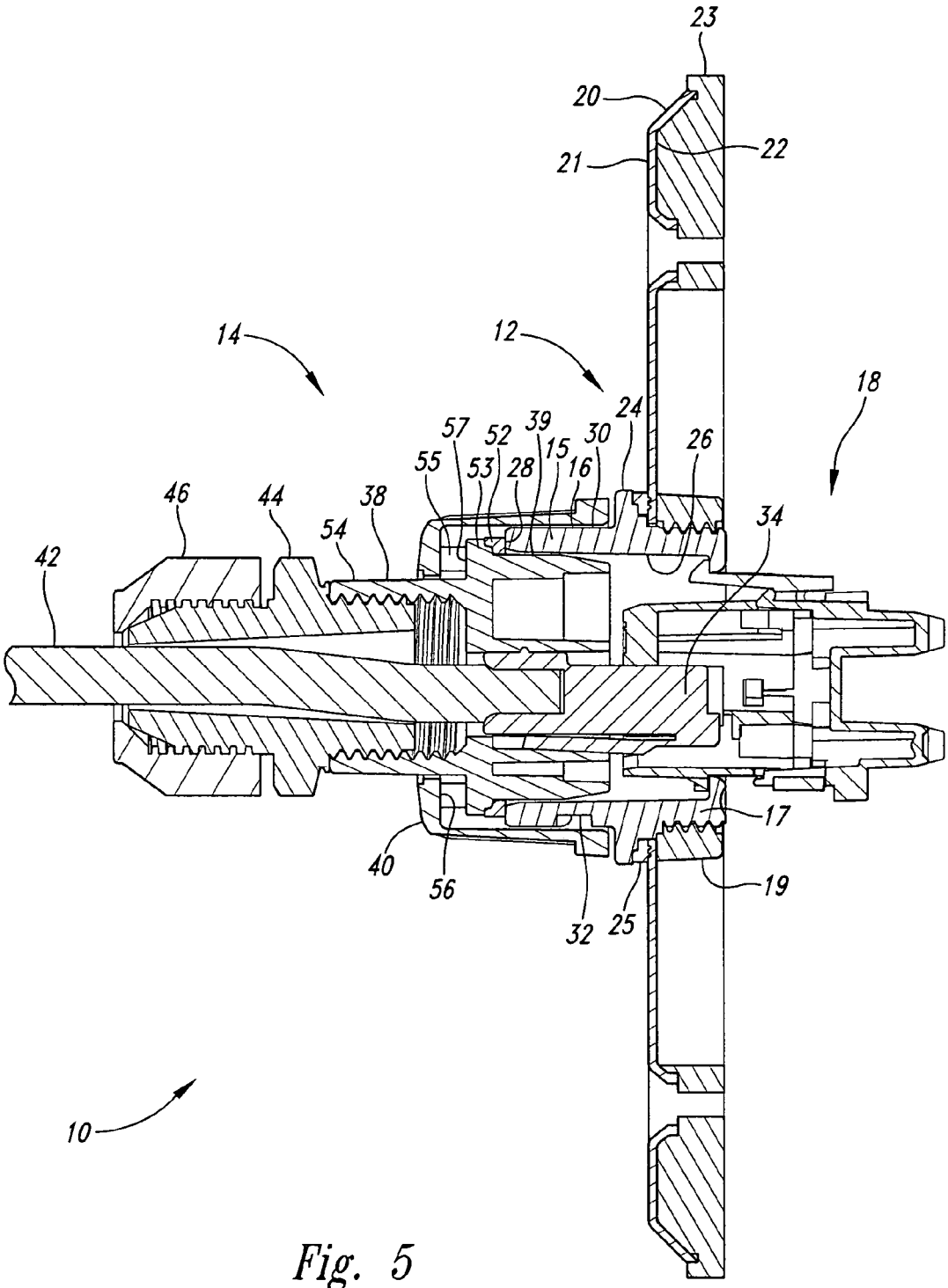
Fig. 5 (Prior Art)
FIG. 5 is a cross-sectional side elevational view of the conventional sealable electrical connector of FIG. 1 shown in the sealed condition with the plug assembly engaged with the connector housing.

The cap body 38 has a flange portion 53 located between the front portion 39 and a rear portion 54 of the cap body to which the cable retainer 44 is attached. A gasket 52 extends around the front portion 39 of the cap body 38 adjacent to the flange portion 53 such that when the plug assembly 14 is coupled to the jack assembly 12, as shown in FIGS. 4 and 5, the gasket 52 abuts against the front end wall surface 28 of the connector housing 16 to provide a seal between the cap body 38 of the plug assembly 14 and the connector housing 16 of the jack assembly 12. This face seal results in a sealed condition for the conventional sealable electrical connector 10.

The rear portion 54 of the cap body 38 projects rearward through a central aperture of the cap 40 such that once the cap body is positioned with the flange portion 53 at the front end wall surface 28 of the connector housing 16, with the gasket 52 positioned therebetween, the cap can be slid forward toward the connector housing along the rear portion of the cap body and rotated to move the engagement members 50 to the end portions 33 of the engagement slots 32. A wave washer spring 55 is located between an inner end surface 56 of the cap 40 and a rearward surface 57 of the cap body 38, adjacent to the flange portion 53. The spring 55 becomes partially compressed when the cap 40 is moved into the secured position holding the cap body 38 in engagement with the connector housing 16, thereby biasing the flange portion 53 toward the front wall surface 28 of the connector housing, with the gasket 52 positioned therebetween, to place the plug assembly 14 in a sealed condition with the jack assembly 12.

Figure 6:
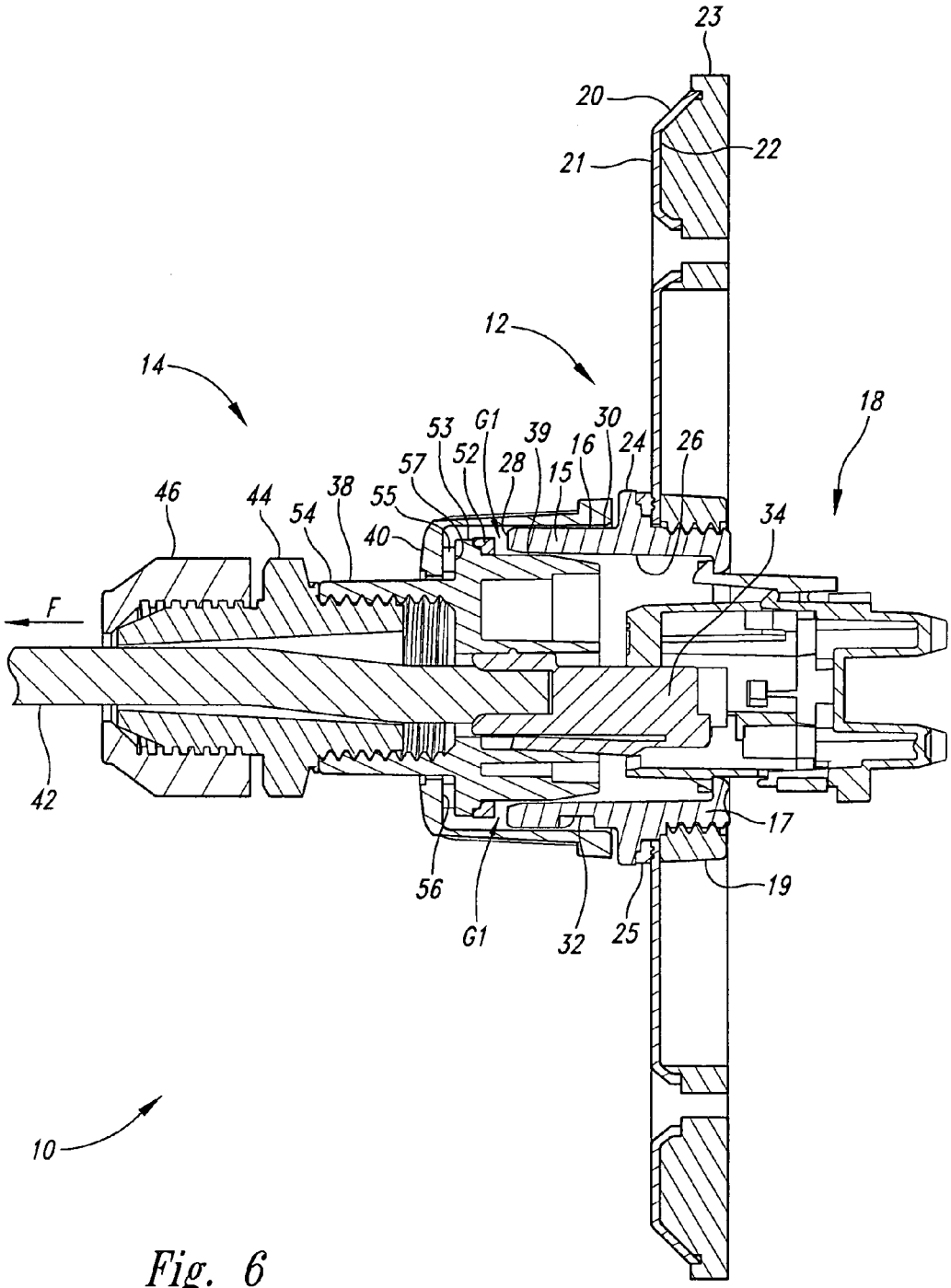
Fig. 6 (Prior Art)
FIG. 6 is a cross-sectional side elevational view of the conventional sealable electrical connector of FIG. 1 shown with the plug assembly being engaged with the connector housing subjected to an external force causing an unsealed condition.

In a first exemplary situation shown in FIG. 6, if a force F is exerted on the cable 42 due to, for instance, a user becoming entangled with the cable, the cap body 38 can slide back in the direction of the force F to further compress the spring 55. Consequently, a gap G1 results between the gasket 52 and the front end wall surface 28 of the connector housing 16 to produce an unsealed condition, which is not desirable as explained above. The same result can occur if the conventional sealable electrical connector 10 is subjected to vibration which generates at least a momentary force F sufficient to produce the gap G1.

Figure 7:
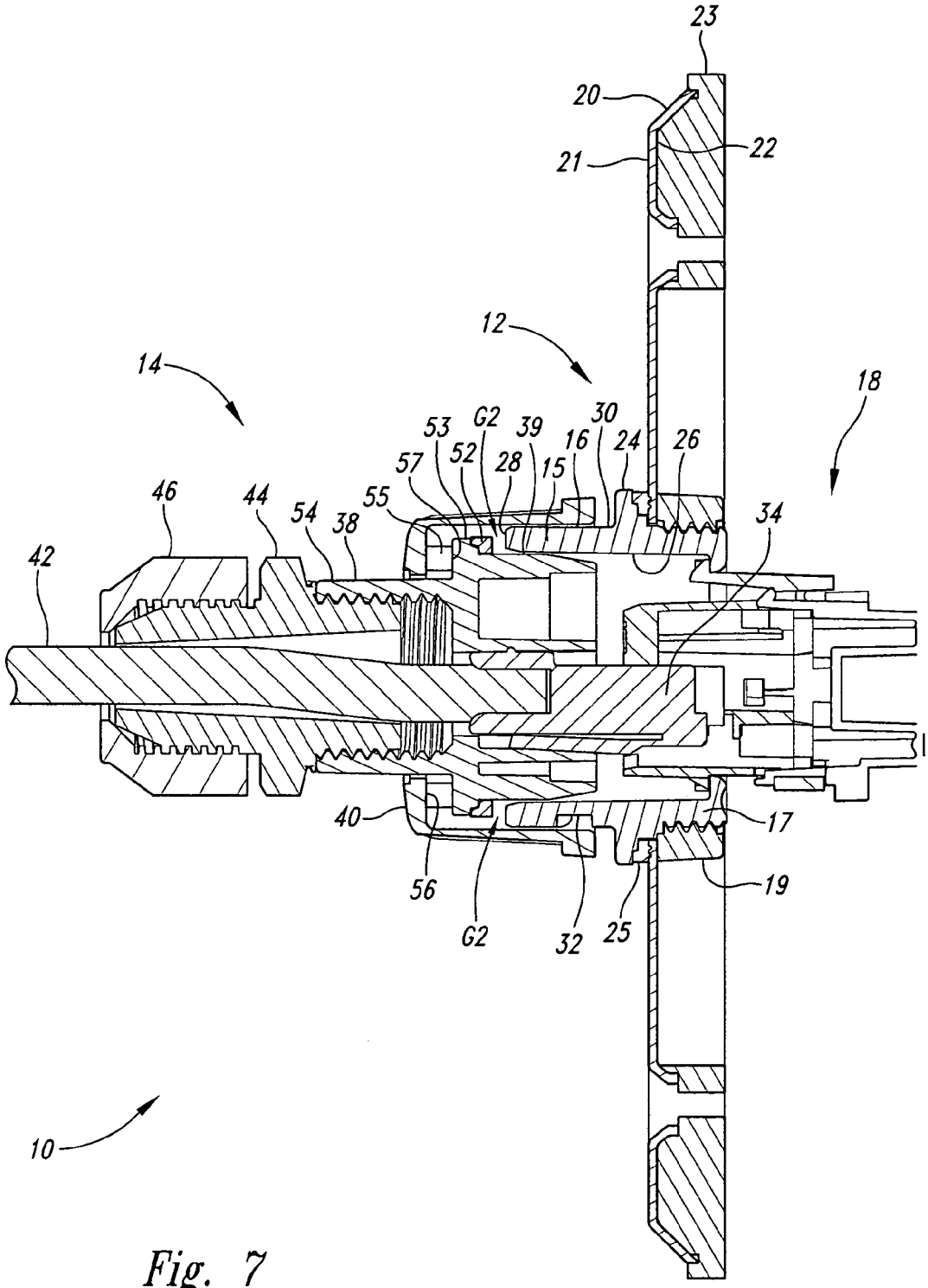
Fig. 7 (Prior Art)
FIG. 7 is a cross-sectional side elevational view of the conventional sealable electrical connector of FIG. 1 shown with the plug assembly being partially disengaged from the connector housing to cause an unsealed condition.
Figure 8:
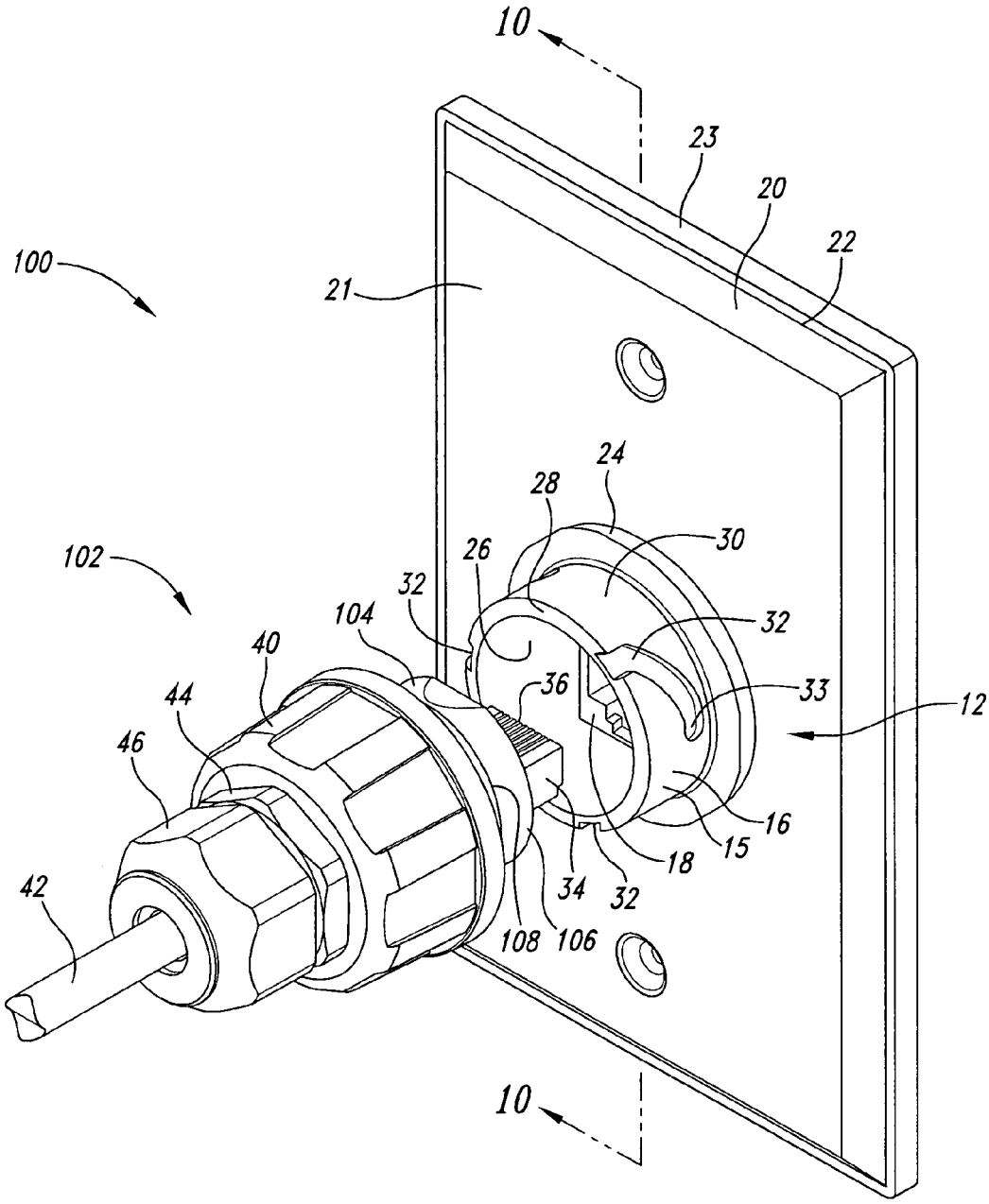
FIG. 8 is an isometric view of a robust sealable electrical connector according to the present invention shown in an unsealed condition with its plug assembly disengaged from its connector housing.
Figure 9:
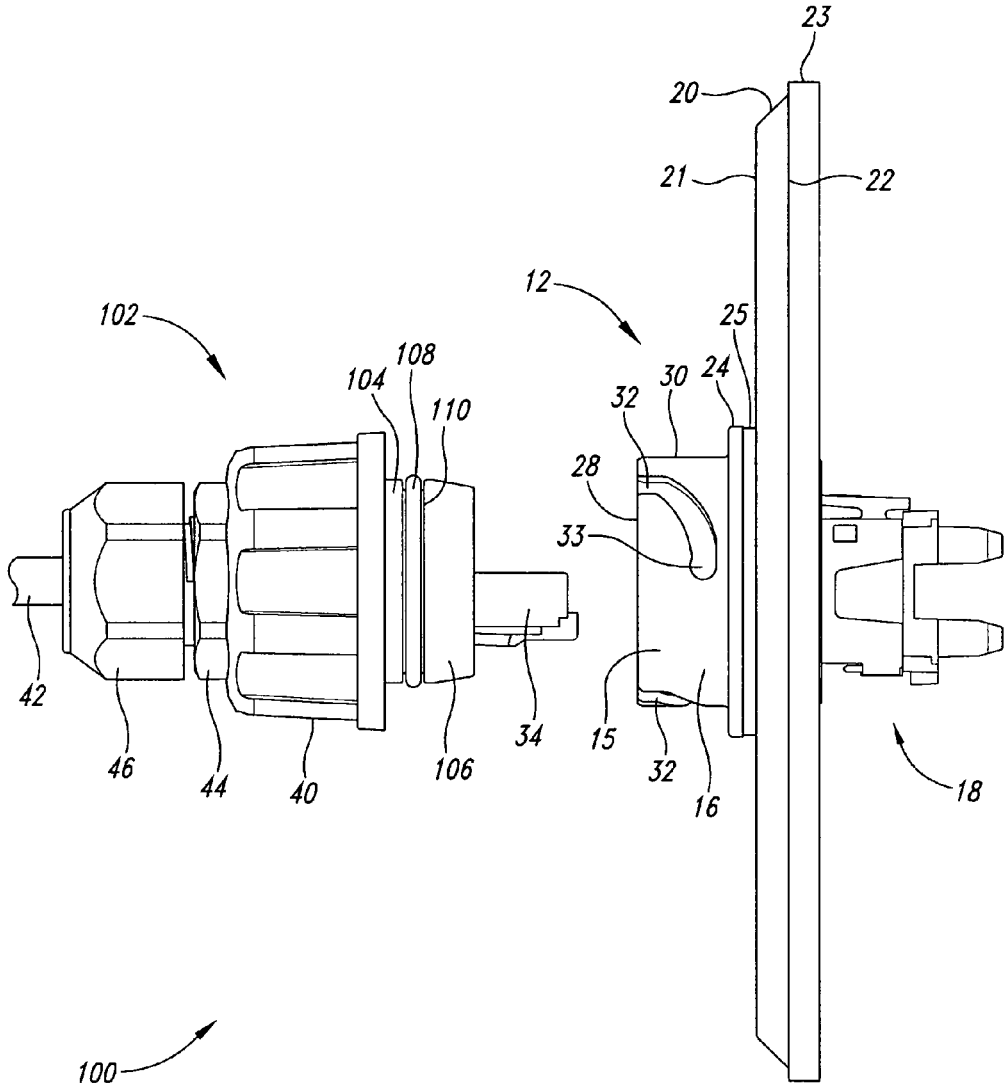
FIG. 9 is a side elevational view of the robust sealable electrical connector of FIG. 8.
Figure 10:
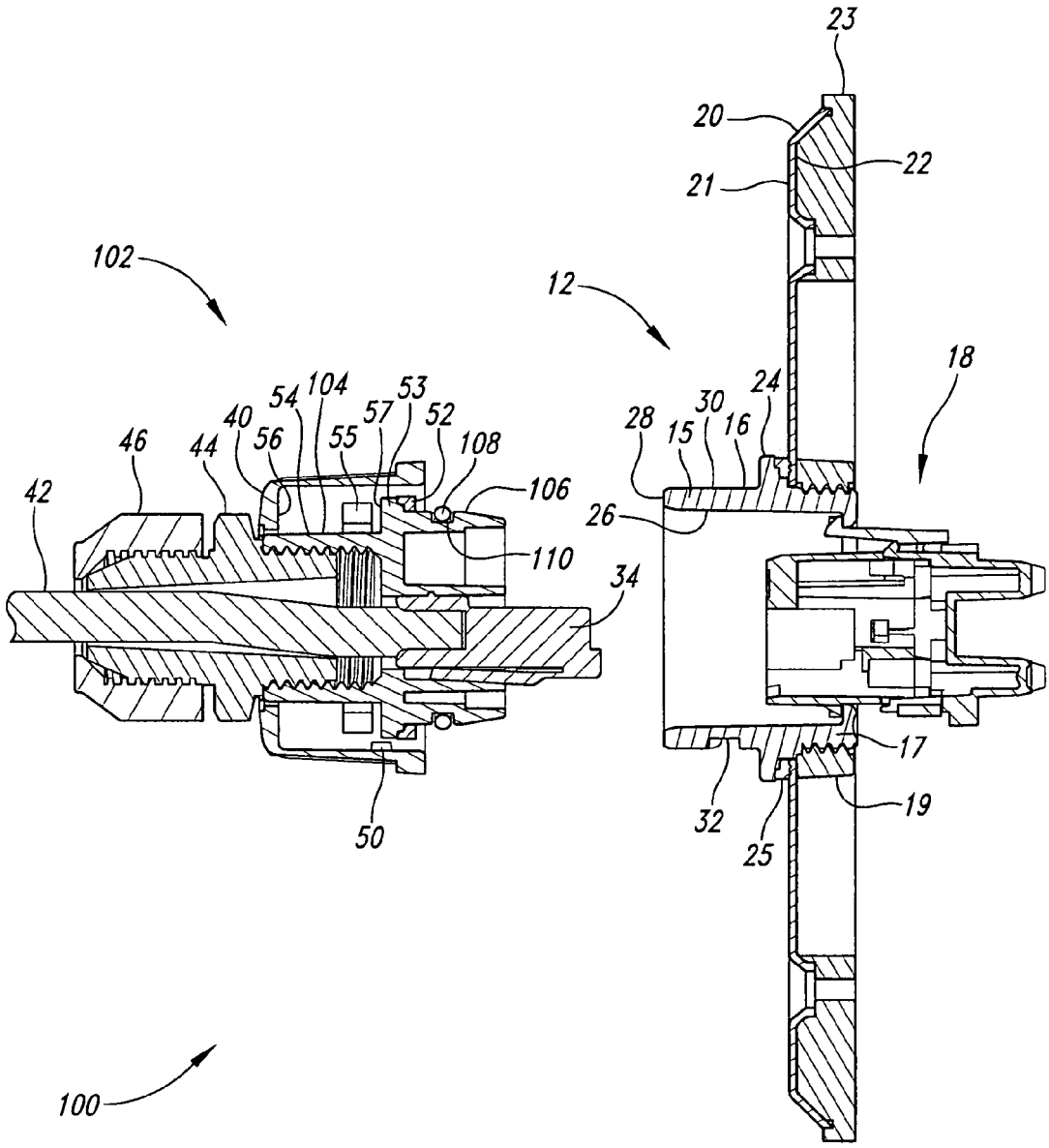
FIG. 10 is a cross-sectional side elevational view of the robust sealable electrical connector of FIG. 8.
Figure 11:
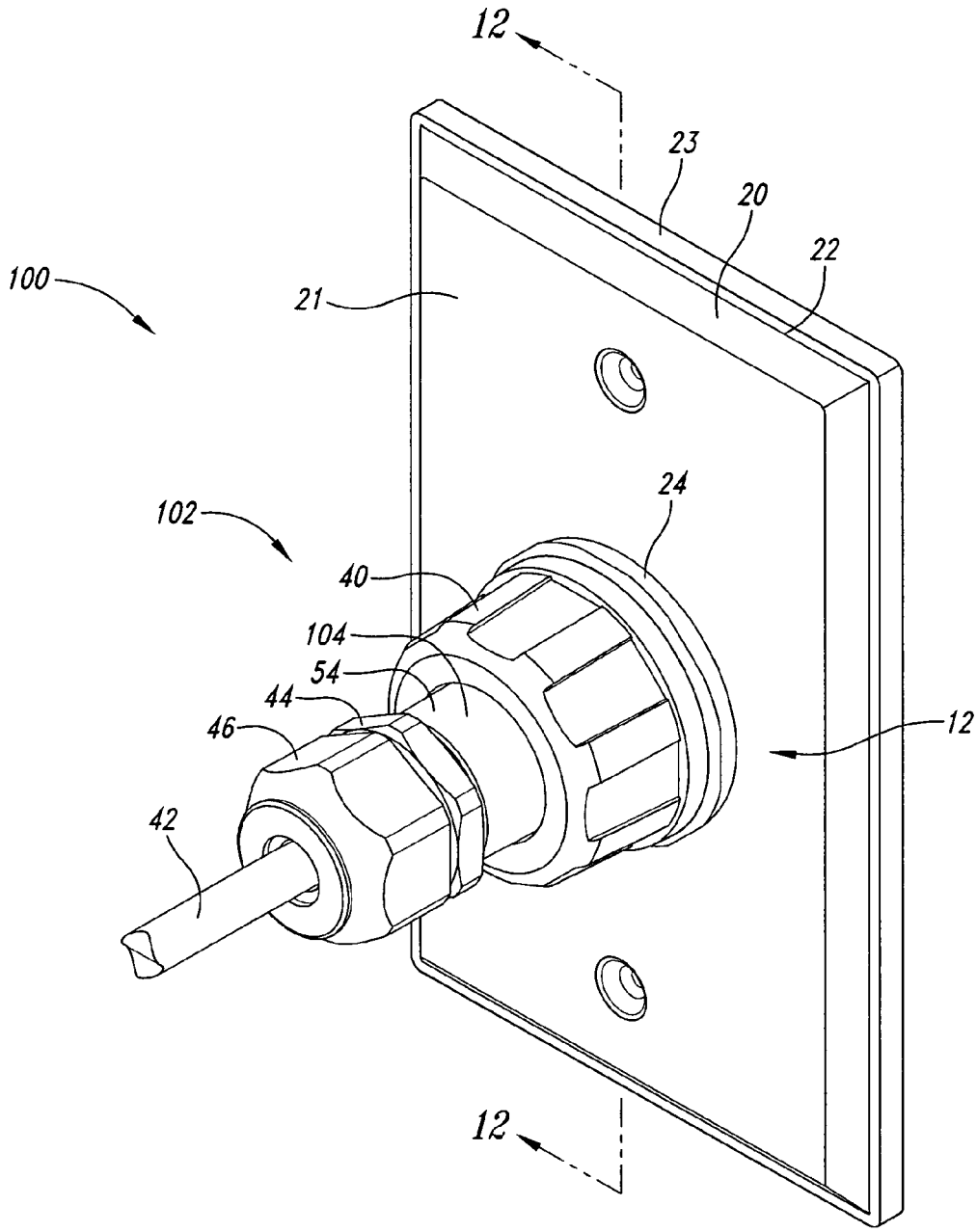
FIG. 11 is an isometric view of the robust sealable electrical connector of FIG. 8 shown in a sealed condition with the plug assembly engaged with the connector housing.
Figure 12:
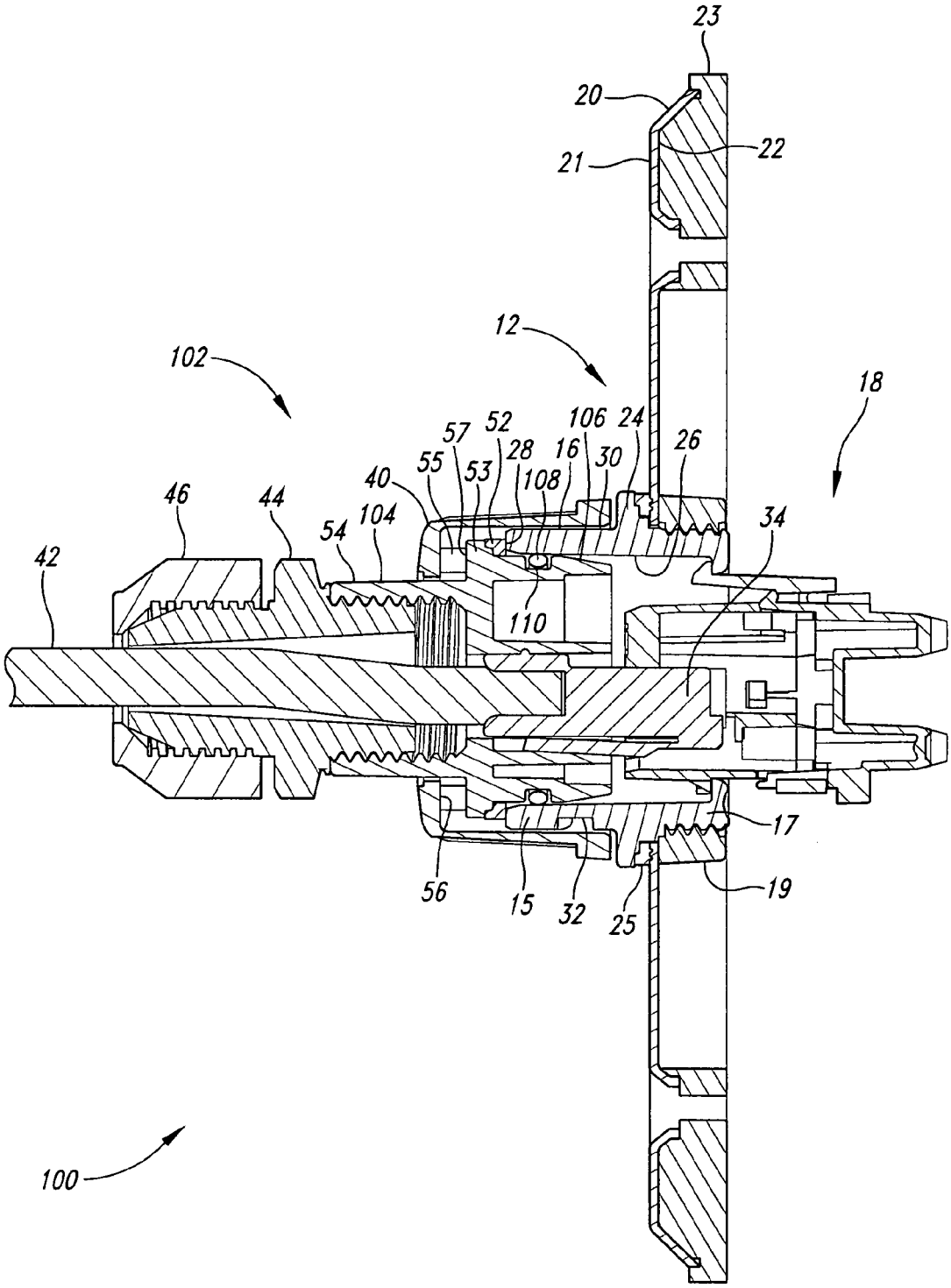
FIG. 12 is a cross-sectional side elevational view of the robust sealable electrical connector of FIG. 8 shown in the sealed condition with the plug assembly engaged with the connector housing.

In a second exemplary situation shown in FIG. 7, the plug assembly 14 becomes partially disengaged from the connector housing 16 when the engagement members 50 of the cap 40 are still engaged with the engagement slots 32 of the connector housing 16, but are not located at the end portions 33 of the engagement slots. Consequently, a gap G2 can result between the gasket 52 and the front end wall surface 28 of the connector housing 16 to produce an unsealed condition, which is also not desirable.

A robust sealable connector 100 according to the present invention is shown in FIGS. 8-14 as having the components of the conventional sealable electrical connector 10 described above with the modifications discussed below. The robust sealable connector 100 is shown mounted to a conventional wall plate 20, however, the connector may also be mounted to a panel or other surface. Further, while illustrated being used as an electrical connector with wires connected through conventional mating electrical plugs and jacks, the robust sealable connector 100 may also be use with optical fibers connected through conventional optical plugs and receptacles.

The robust sealable electrical connector 100 has a first connector assembly and a second connector assembly which, for the purposes of describing the illustrated sealable electrical connector, are referred to herein as a plug assembly 102 and the jack assembly 12, respectively. The plug assembly 102 includes a cover or cap body 104 with a modified front portion 106 and a sealing member 108 positioned to extend circumferentially around the modified front portion. The modified front portion 106 is shaped and sized to accommodate the location and the type of the sealing member 108 selected for use so that both the modified front portion and the sealing member will fit snugly into the connector housing 16. In the implementation depicted in FIG. 9, the modified front portion 106 has a circumferential groove 110 to receive the sealing member 108. The inner surface 26 of the connector housing 16 of the jack assembly 12 has a smooth wall surface at least along the lengthwise portion thereof sealingly engaged by the sealing member 108 as the plug assembly is inserted into the forward portion 15 of the connector housing.

In the depicted implementation, the sealing member 108 is an O-ring such as provided by the Parker Hannifin Corporation. In other implementations the sealing member could be multiple O-rings or seal other than an O-ring such a pliable sheet layered onto the front portion 106 of the cap body 104. To accommodate a layered pliable sheet, the modified front portion 106 would be sized to have an overall reduction in its outer diameter to maintain the ability to fit the modified front portion with the sealing member thereon within the connector housing 16 and provide a seal therebetween. In an alternative not illustrated, the sealing member 108 could be replaced or supplemented with a sealing member affixed to the connector housing 16 along the inner surface 26 thereof, and the front portion 106 plug assembly 102 would have a smooth wall surface at least along the lengthwise portion thereof sealingly engaged by the sealing member of the connector housing as the plug assembly is inserted into the forward portion 15 of the connector housing.

When the plug assembly 102 is fully engaged with the jack assembly 12, the gasket 52 abuts against the front end wall surface 28 of the connector housing 16 to provide for a sealed condition for the robust sealable electrical connector 100 in a manner similar to that described above for the conventional sealable electrical connector 10. However, the sealing member 108 provides an additional seal between the modified front portion 106 and the inner surface 26 of the connector housing 16 to maintain seal therebetween even should the gasket 52 fail to maintain the sealed condition and a gap develops between the gasket and the front end wall surface 28 of the connector housing 16 which as described above would otherwise produce a gap G1 or G2 and result in an unsealed condition. Instead, even if such a gap develops, the sealing member 108 will continue to maintain the sealed condition of the plug assembly 14 with the jack assembly 12. If the plug assembly 102 is not in a fully inserted position may be spaced apart from the fully inserted position sufficient that the flange portion 53 of the cap body 104 and the front end wall surface 28 of the connector housing 16 are sufficiently distance that the gasket 52 does not provide a seal between the connector housing and the cap body. Yet, in such a position while the plug assembly 102 is still at least partially inserted, the second seal provided by the sealing member 108 between the connector housing 16 and the cap body 104 will be maintained.

Figure 13:
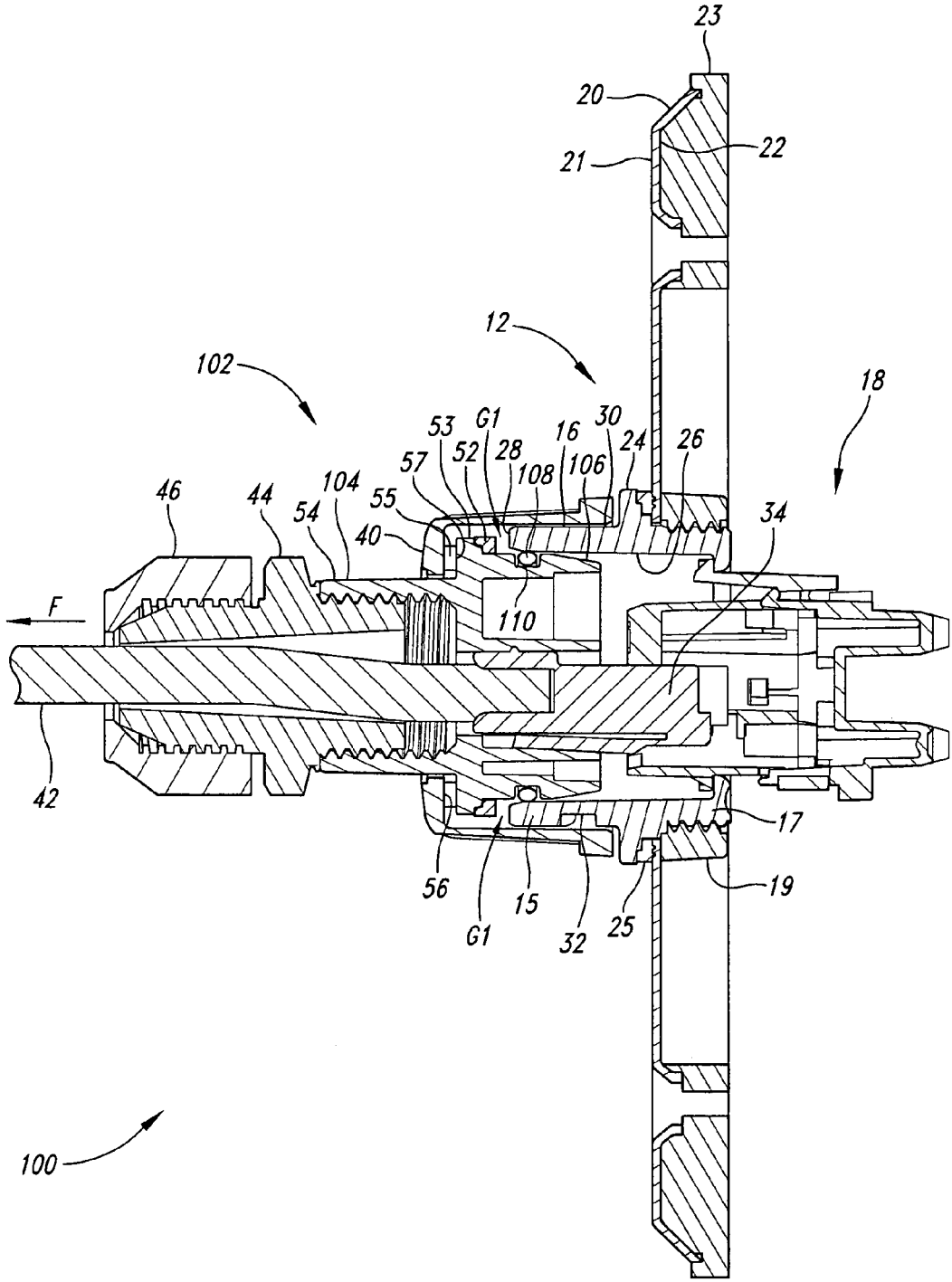
FIG. 13 is a cross-sectional side elevational view of the robust sealable electrical connector of FIG. 8 shown with the plug assembly being engaged with the connector housing and subjected to an external force causing the conventional gasket to lose seal but with a sealing member according to the present invention retaining a sealed condition.

For instance, if the robust sealable electrical connector 100 were in the first exemplary situation (described above for the conventional sealable electrical connector 10), the force F would still produce the gap G1 between the gasket 52 and the front end wall surface 28 of the connector housing 16 as shown in FIG. 13. However, as also shown in FIG. 13, despite the force F creating the gap G1, the sealing member 108 would continue to provide a seal between the modified front portion 106 and the inner surface 26 of the connector housing 16 and maintain the sealed condition despite the presence of the gap G1.

Figure 14:
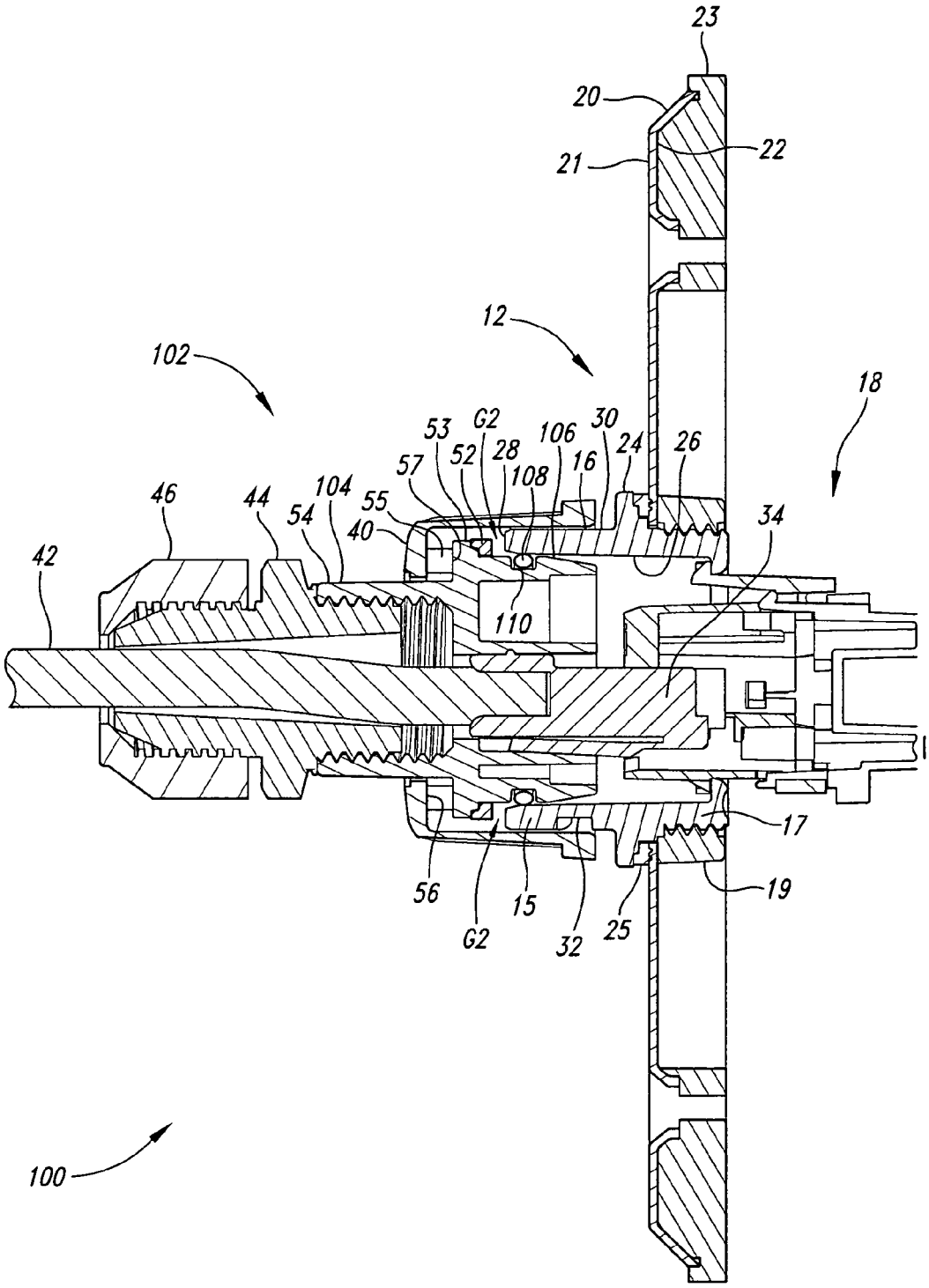
FIG. 14 is a cross-sectional side elevational view of the robust sealable electrical connector of FIG. 8 shown with the plug assembly being partially disengaged with the connector housing to cause the conventional gasket to lose seal but with the sealing member according to the present invention retaining a sealed condition.

As another example, if the robust sealable electrical connector 100 were in the second exemplary situation (described above for the conventional sealable electrical connector 10), the plug assembly 102 would still become partially disengaged from the connector housing 16 and produce the gap G2. As described above, this results when the engagement members 50 of the cap 40 still engage the engagement slots 32 of the connector housing 16 but are not located at the end portions 33 of the engagement slots. While the gap G2 would still result between the gasket 52 and the front surface 28 of the connector housing 16 as shown in FIG. 14, as also shown in FIG. 14, despite the partial disengagement of the plug assembly 102 from the connector housing 16, the sealing member 108 would continue to provide a seal between the modified front portion 106 and the inner surface 26 of the connector housing 16 and maintain the sealed condition.

The size of gap G1 and G2 that can be tolerated with the sealing member 108 still maintaining the sealed condition depends on the length of the inner surface 26 of the connector housing 16 engaged by the sealing member as the plug assembly 102 is moved rearward from its normal fully engaged position with the connector housing.

As can be readily understood, the sealing member 108 overcomes the deficiencies of the conventional sealable electrical connector 10 and provides a connector 100 with a dual seal between the plug assembly 102 and the jack assembly 12 that is better suited for use in adverse environments where hostile environmental elements might otherwise penetrate the connector and degrade or disable its electrical performance. The connector 100 is well suited for use as part of an industrial patch cord housing where exposure to fluids, particulates, and other materials are possible and likely. While the robust sealable electrical connector 100 of the present invention is illustrated with the contact plug 34 of the plug assembly 102 shown as an RJ45 plug and mating contact jack 18, the connector may be designed for other style mating electrical plugs and jacks, and as noted above may be used as a robust sealable optical connector with a variety of styles of fiber optic connectors. Further, while the robust sealable electrical connector 100 has been illustrated with a plug assembly 102 (the first connector assembly) holding a plug 34 and the jack assembly 12 (the second connector assembly) holding a jack 18, the positions of the plug and jack could be reversed within the two connector assemblies from that illustrated if desired with appropriate modifications to the connector assemblies so that they adequately retain the plug and jack therein. Of course, when the robust sealable connector is used for optical fibers, the optical plug and receptacle can be retained within either one of the two connector assemblies, as desired.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

The invention claimed is:

1. A connector assembly comprising:

a first connector;

a second connector, the first and second connectors being configured to be operably coupled together;

a housing having an inner surface extending along a first dimension to at least partially define an inner space, an open end to provide access to the inner space, and an end surface extending about the inner space toward the open end, the second connector being at least partially located within the inner space of the housing for access therewith through the open end of the housing;

a body within which the first connector is at least partially located, the body being sized to be inserted into the inner space of the housing through the open end of the housing to a fully inserted position whereat the first connector is operably coupled to the second connector of the housing, the body having first and second outer surfaces, the first outer surface extending about and positioned outward of the second outer surface;

a first sealing member positioned at the first outer surface of the body and positioned for sealing contact with the end surface of the housing and the first outer surface of the body to provide a first seal between the housing and the body when the body is inserted into the housing and in the fully inserted position; and a second sealing member sealingly contacting both the second outer surface of the body and the inner surface of the housing as the body is moved from the fully inserted position to a less than fully inserted position along the first dimension of the housing to provide a second seal between the housing and the body at all positions between the fully inserted position and the less than fully inserted position, the less than fully inserted position being spaced apart from the fully inserted position sufficient that the first outer surface of the body and the end surface of the housing are sufficiently distance that the first sealing member does not provide the first seal between the housing and the body.

2. The connector assembly of claim 1 wherein the second sealing member is an O-ring.

3. The connector assembly of claim 2 wherein the second outer surface has a groove extending thereabout with the O-ring positioned therein.

4. The connector assembly of claim 1 wherein the body has an outwardly projecting flange and the first outer surface of the body is a surface of the flange positioned to face toward the housing when the body is inserted into the inner space of the housing, and the body has an outer wall with the second outer surface being a portion thereof.

5. A connector assembly for use with a first connector and a second connector configured to be operably coupled together, the connector assembly comprising:

a housing having an inner surface extending along a first dimension to at least partially define an inner space, an open end to provide access to the inner space, and an end surface extending about the inner space toward the open end, the housing being configured to at least partially receive the second connector within the inner space of the housing for access therewith through the open end of the housing;

a body configured to at least partially receive the first connector therewithin, the body being sized to be inserted into the inner space of the housing through the open end of the housing to a first position whereat the first and second connectors are operably coupled together, the body having first and second outer surfaces;

a first sealing member positioned at the first outer surface of the body and positioned for sealing contact with the end surface of the housing and the first outer surface of the body to provide a first seal between the housing and the body when the body is inserted into the housing and in the first position, the first sealing member being positioned with respect to the first outer surface of the body and the end surface of the housing such that when the body is inserted into the housing and in a second position spaced sufficiently apart from the first position along the first dimension of the housing the first sealing member does not provide the first seal between the housing and the body; and a second sealing member sealingly contacting both the second outer surface of the body and the inner surface of the housing when the body is at all positions between the first position and a second position to provide a second seal between the housing and the body.

6. The connector assembly of claim 5 wherein the second sealing member is an O-ring.

7. The connector assembly of claim 6 wherein the second outer surface has a groove extending thereabout with the O-ring positioned therein.

8. A connector assembly for use with a housing and a housing connector, the housing having an inner surface extending along a first dimension to at least partially define an inner space, an open end to provide access to the inner space, and an end surface extending about the inner space toward the open end, the housing connector being at least partially located within the inner space of the housing for access therewith through the open end of the housing, the connector assembly comprising:

a mating connector configured to be operably coupled to the housing connector;

a body within which the mating connector is at least partially located, the body being sized to be inserted into the inner space of the housing through the open end of the housing to a fully inserted position whereat the mating connector is operably coupled to the housing connector, the body having first and second outer surfaces, the first outer surface extending about and positioned outward of the second outer surface;

a first sealing member positioned at the first outer surface of the body and positioned for sealing contact with the end surface of the housing and the first outer surface of the body to provide a first seal between the housing and the body when the body is inserted into the housing and in the fully inserted position; and a second sealing member sealingly contacting both the second outer surface of the body and the inner surface of the housing as the body is moved from the fully inserted position to a less than fully inserted position along the first dimension of the housing to provide a second seal between the housing and the body at all positions between the fully inserted position and the less than fully inserted position, the less than fully inserted position being spaced apart from the fully inserted position sufficient that the first outer surface of the body and the end surface of the housing are sufficiently distance that the first sealing member does not provide the first seal between the housing and the body.

9. The connector assembly of claim 8 wherein the second sealing member is an O-ring.

10. The connector assembly of claim 9 wherein the second outer surface has a groove extending thereabout with the O-ring positioned therein.

11. The connector assembly of claim 8 wherein the body has an outwardly projecting flange and the first outer surface of the body is a surface of the flange positioned to face toward the housing when the body is inserted into the inner space of the housing, and the body has an outer wall with the second outer surface being a portion thereof.

12. A connector assembly for use with a housing and a housing connector, the housing having an inner surface extending along a first dimension to at least partially define an inner space, an open end to provide access to the inner space, and an end surface extending about the inner space toward the open end, the housing connector being at least partially located within the inner space of the housing for access therewith through the open end of the housing, the connector assembly comprising:

a mating connector configured to be operably coupled to the housing connector;

a body within which the mating connector is at least partially located, the body being sized to be inserted into the inner space of the housing through the open end of the housing to a first position whereat the mating connector is operably coupled to the housing connector, the body having first and second outer surfaces;

a first sealing member positioned at the first outer surface of the body and positioned for sealing contact with the end surface of the housing and the first outer surface of the body to provide a first seal between the housing and the body when the body is inserted into the housing and in the first position, the first sealing member being positioned with respect to the first outer surface of the body and the end surface of the housing such that when the body is inserted into the housing and in a second position spaced sufficiently apart from the first position along the first dimension of the housing the first sealing member does not provide the first seal between the housing and the body; and a second sealing member sealingly contacting both the second outer surface of the body and the inner surface of the housing when the body is at all positions between the first position and the second position to provide a second seal between the housing and the body.

13. The connector assembly of claim 12 wherein the second sealing member is an O-ring.

14. The connector assembly of claim 13 wherein the second outer surface has a groove extending thereabout with the O-ring positioned therein.

15. A connector assembly for use with a first connector configured to be operably coupled to a second connector and a housing with an inner surface extending along a first dimension to at least partially define an inner space, an open end to provide access to the inner space, and an end surface extending about the inner space toward the open end, the second connector being at least partially located within the inner space of the housing for access therewith through the open end of the housing, the connector assembly comprising:

a body configured to receive the first connector at least partially therewithin, the body being sized to be inserted into the inner space of the housing through the open end of the housing to a fully inserted position whereat the first connector is operably coupled to the second connector of the housing, the body having first and second outer surfaces, the first outer surface extending about and positioned outward of the second outer surface;

a first sealing member positioned at the first outer surface of the body and positioned for sealing contact with the end surface of the housing and the first outer surface of the body to provide a first seal between the housing and the body when the body is inserted into the housing and in the fully inserted position; and a second sealing member sealingly contacting both the second outer surface of the body and the inner surface of the housing as the body is moved from the fully inserted position to a less than fully inserted position along the first dimension of the housing to provide a second seal between the housing and the body at all positions between the fully inserted position and the less than fully inserted position, the less than fully inserted position being spaced apart from the fully inserted position sufficient that the first outer surface of the body and the end surface of the housing are sufficiently distance that the first sealing member does not provide the first seal between the housing and the body.

16. The connector assembly of claim 15 wherein the second sealing member is an O-ring.

17. The connector assembly of claim 16 wherein the second outer surface has a groove extending thereabout with the O-ring positioned therein.

18. A connector assembly for use with a first connector configured to be operably coupled to a second connector and a housing with an inner surface extending along a first dimension to at least partially define an inner space, an open end to provide access to the inner space, and an end surface extending about the inner space toward the open end, the second connector being at least partially located within the inner space of the housing for access therewith through the open end of the housing, the connector assembly comprising:

a body configured to receive the first connector, the body being sized to be inserted into the inner space of the housing through the open end of the housing to a first position whereat the first connector is operably coupled to the second connector of the housing, the body having first and second outer surfaces;

a first sealing member positioned at the first outer surface of the body and positioned for sealing contact with the end surface of the housing and the first outer surface of the body to provide a first seal between the housing and the body when the body is inserted into the housing and in the first position, the first sealing member being positioned with respect to the first outer surface of the body and the end surface of the housing such that when the body is inserted into the housing and in a second position spaced sufficiently apart from the first position along the first dimension of the housing the first sealing member does not provide the first seal between the housing and the body; and a second sealing member sealingly contacting both the second outer surface of the body and the inner surface of the housing when the body is at all positions between the first position and the second position to provide a second seal between the housing and the body.

19. The connector assembly of claim 18 wherein the second sealing member is an O-ring.

20. The connector assembly of claim 19 wherein the second outer surface has a groove extending thereabout with the O-ring positioned therein.

* * * * *